US009187275B2

(12) United States Patent
Hashimoto

(10) Patent No.: US 9,187,275 B2
(45) Date of Patent: Nov. 17, 2015

(54) IMAGE FORMING APPARATUS

(71) Applicant: Brother Kogyo Kabushiki Kaisha, Nagoya-shi, Aichi-ken (JP)

(72) Inventor: Yohei Hashimoto, Nagakute (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/501,330

(22) Filed: Sep. 30, 2014

(65) Prior Publication Data

US 2015/0091242 A1 Apr. 2, 2015

(30) Foreign Application Priority Data

Sep. 30, 2013 (JP) ..... 2013-203744

(51) Int. Cl.
*B65H 3/06* (2006.01)

(52) U.S. Cl.
CPC ..... *B65H 3/0669* (2013.01); *B65H 2403/722* (2013.01); *B65H 2405/11* (2013.01)

(58) Field of Classification Search
CPC ..... B65H 3/0669; B65H 2403/722; B65H 2405/10; B65H 2405/11; B65H 1/266
USPC ..... 271/164
See application file for complete search history.

(56) References Cited

U.S. PATENT DOCUMENTS

| | | | | |
|---|---|---|---|---|
| 4,685,792 | A * | 8/1987 | Iseki et al. | 271/114 |
| 4,799,662 | A * | 1/1989 | Sagara et al. | 271/114 |
| 4,998,714 | A * | 3/1991 | Sparer et al. | 271/117 |
| 6,299,157 | B1 * | 10/2001 | Lim | 271/117 |
| 6,578,840 | B1 * | 6/2003 | Kudo | 271/10.13 |
| 8,322,703 | B2 * | 12/2012 | Miwa | 271/10.13 |
| 8,657,282 | B2 * | 2/2014 | Hashimoto et al. | 271/186 |
| 2011/0233846 | A1 | 9/2011 | Miwa | |

FOREIGN PATENT DOCUMENTS

| | | | |
|---|---|---|---|
| EP | 2 368 821 | A2 | 9/2011 |
| JP | H11-222335 | A | 8/1999 |
| JP | 2011-195319 | A | 10/2011 |

* cited by examiner

*Primary Examiner* — Jeremy R Severson
(74) *Attorney, Agent, or Firm* — Banner & Witcoff, Ltd.

(57) ABSTRACT

An image forming apparatus includes an image forming unit, a main body including the image forming unit and having an opening open in a horizontal direction, a sheet supply tray including a contact portion, a retaining mechanism disposed at the main body, a feed roller disposed at the main body, a pivotable member disposed at the main body and including a contact portion, and a clutch mechanism. The pivotable member is configured to, when the sheet supply tray is attached to the main body, pivot from a first position to a second position by the contact portion of the pivotable member receiving a force having the vertical direction from the contact portion of the sheet supply tray. The clutch mechanism is configured to allow or cut-off transmission of a driving force to the feed roller in response to the sheet supply tray relative to the main body.

10 Claims, 7 Drawing Sheets

IMAGE FORMING APPARATUS

CROSS REFERENCE TO RELATED APPLICATION

This application claims priority from Japanese Patent Application No. 2013-203744, filed on Sep. 30, 2013, which is incorporated herein by reference in its entirety.

TECHNICAL FIELD

Aspects of the disclosure relate to an image forming apparatus configured to form an image on a sheet.

BACKGROUND

A known image forming apparatus includes a clutch mechanism configured to, when a sheet supply tray is removed from a main body, cut off transmission of a driving force to a feed roller. The clutch mechanism is configured to, when an end of a link of the clutch mechanism is pressed by a contact portion disposed at the sheet supply tray, transmit the driving force to the feed roller.

When the sheet supply tray is removed from the main body and the contact portion is separated from the end of the link, a spring, which has been elastically deformed, returns to its original state, the link is moved by an urging force of the spring, and the clutch mechanism is in a state where the transmission of the driving force is cut off.

When the sheet supply tray is attached to the main body, that is, when the end of the link is pressed by the contact portion, the spring exerts an elastic force on the sheet supply tray in a direction to separate the sheet supply tray from the main body.

SUMMARY

In the above image forming apparatus, when the sheet supply tray is mounted in the apparatus body, the sheet supply tray is subjected to a force having a direction in which the sheet supply tray is removed from the apparatus body. Accordingly, in the image forming apparatus, a retaining mechanism to retain the position of the sheet supply tray needs to be provided, and a retaining force generated by the retaining mechanism needs to be set to a large value.

The large retaining force inevitably increases a force required to mount and remove the sheet supply tray into and from the apparatus body. Thus, the operability in terms of installation and removal of the sheet supply tray may decrease.

Accordingly, it is an object of the present disclosure to prevent a decrease in the operability in terms of installation and removal of a sheet supply tray.

According to an aspect of the disclosure, an image forming apparatus may include an image forming unit, a main body including the image forming unit and having an opening open in a horizontal direction, a sheet supply tray, a retaining mechanism disposed at the main body, a feed roller disposed at the main body, a pivotable member disposed at the main body, and a clutch mechanism. The image forming unit is configured to form an image on a sheet. The sheet supply tray is detachably attached to the main body through the opening and configured to receive a stack of sheets to be supplied to the image forming unit. The sheet supply tray includes a contact portion. The retaining mechanism is configured to retain a position of the sheet supply tray attached to the main body. The feed roller is configured to feed a sheet received at the sheet supply tray toward the image forming unit. The pivotable member includes a contact portion. The pivotable member is configured to, when the sheet supply tray is attached to the main body, pivot from a first position to a second position by the contact portion of the pivotable member receiving a force having the vertical direction from the contact portion of the sheet supply tray. The clutch mechanism is configured to, when the contact portion of the pivotable member is in contact with the contact portion of the sheet supply tray, transmit a driving force to the feed roller. The clutch mechanism is configured to, when the contact portion of the pivotable member is separated from the contacted portion of the sheet supply tray, cut off transmission of the driving force to the feed roller.

BRIEF DESCRIPTION OF THE DRAWINGS

For a more complete understanding of the present disclosure, needs satisfied thereby, and the objects, features, and advantages thereof, reference now is made to the following description taken in connection with the accompanying drawings.

DETAILED DESCRIPTION

Figure 1:
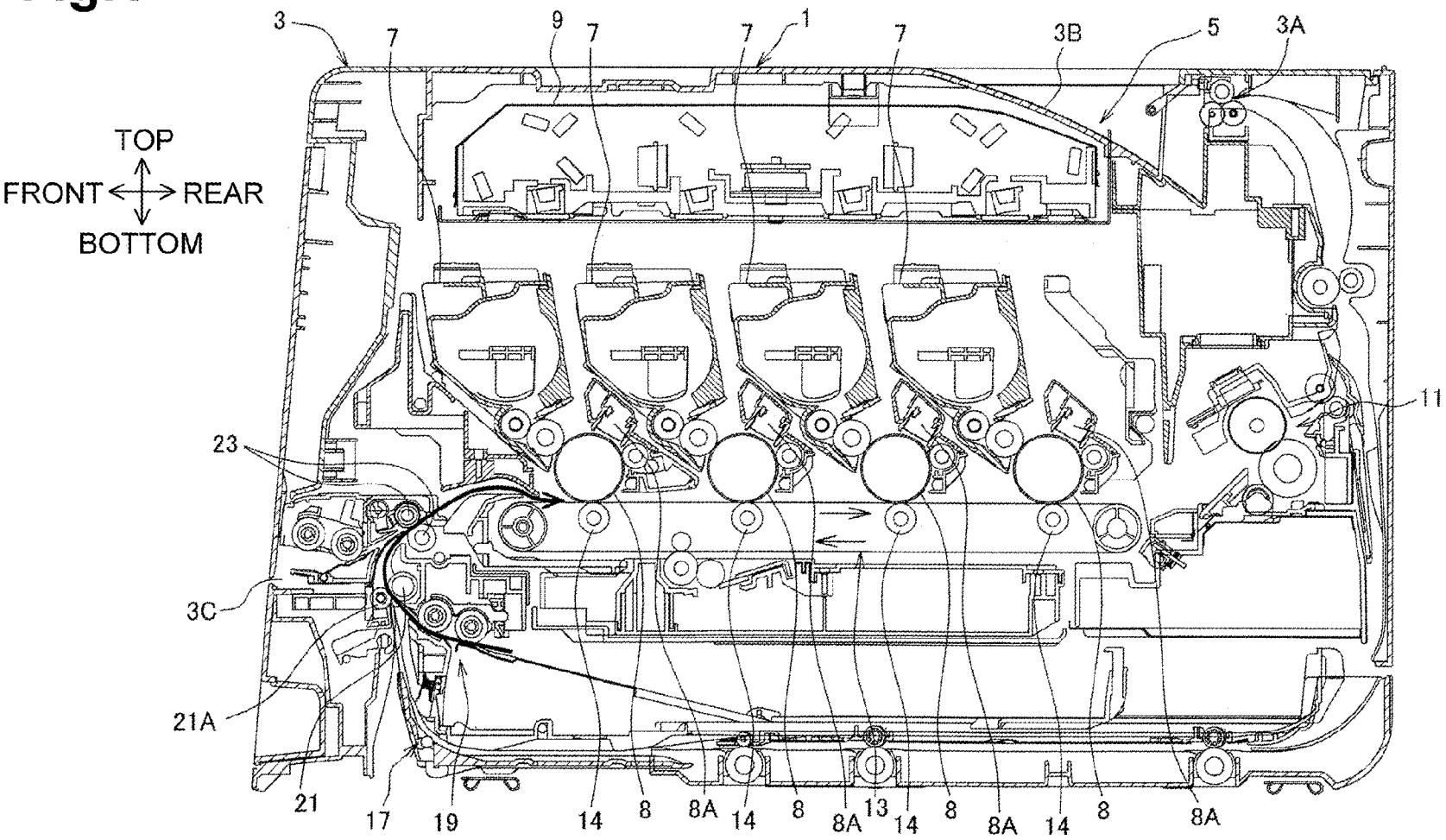
FIG. 1 is a central sectional view of an image forming apparatus in the middle according to an illustrative embodiment of the disclosure.

According to the present illustrative embodiment, the disclosure is applied to an electrophotographic image forming apparatus. Arrows in the accompanying drawings are given to ease understanding of a relationship among the drawings. Directions described in the disclosure are not limited to the directions of the arrows illustrated in the drawings.

At least one member or portion illustrated with a reference numeral is provided in the image forming apparatus. Illustrative embodiments are described below with reference to the accompanying drawings.

As illustrated in FIG. 1, an image forming apparatus 1 includes, in a main casing 3, an electrophotographic image forming unit 5 that forms an image on a sheet, such as a paper sheet. The image forming unit 5 includes a plurality of development cartridges 7, a plurality of photosensitive drums 8, a plurality of chargers 8A, an exposure unit 9, and a fixing unit 11.

Each of the development cartridges 7 arranged in a line contains a developer. The development cartridges 7 located from one end (the front end in the present illustrative embodiment) to the other end (the rear end in the present illustrative embodiment) of the arrangement contain yellow developer, magenta developer, cyan developer, and black developer.

The photosensitive drums 8 and the chargers 8A are provided in equal numbers to the development cartridges 7. Each of the chargers 8A charges one of the photosensitive drums 8 located at a corresponding position. The exposure unit 9 exposes each of the charged photosensitive drums 8. The exposed photosensitive drum 8 has an electrostatic latent image formed thereon. When a developer is supplied to each of the photosensitive drums 8 having an electrostatic latent image formed thereon, a developer image corresponding to the electrostatic latent image is retained on the outer peripheral surface of the photosensitive drum 8.

A belt 13 is a band-like endless belt. The belt 13 conveys a sheet from the frontmost development cartridge 7 toward the rearmost development cartridge 7 arranged in a line. A plurality of transfer members 14 is disposed so as to face one of the photosensitive drums 8 with the belt 13 therebetween. A transfer voltage is applied to the transfer members 14. Accordingly, the developer images retained on the photosensitive drums 8 are transferred one on top of the other on the same sheet.

The fixing unit 11 applies pressure and heat to the sheet having the developer images transferred thereonto to fix the developer images onto the sheet. The sheet having the image formed thereon is output onto an ejection tray 3B provided on the chassis 3 using, for example, an ejection roller 3A.

A feeder mechanism 19 is disposed upstream of the belt 13 in the sheet feeding direction. The feeder mechanism 19 feeds sheets stacked on the sheet supply tray 17 to the image forming unit 5 one by one.

The sheet supply tray 17 is a loading unit that allows a plurality of sheets stacked thereon. The lower portion of the front surface of the chassis 3 has an opening 3C that extends horizontally. Thus, the sheet supply tray 17 can be removably inserted into the main body (the chassis 3) of the apparatus through the opening 3C. Thus, the sheet supply tray 17 is mounted in the main body.

The term "main body" refers to a portion of the image forming apparatus 1 that is not separated or removed by a user during a normal use. The main body may include the chassis 3 and main frames 15 (refer to FIG. 2). The main frames 15 are substantially plate-like strength members. The main frames 15 are disposed on respective sides of the image forming unit 5 in the horizontal direction. The chassis 3 may include an exterior cover that covers the main frame 15 from the outside.

Figure 2:
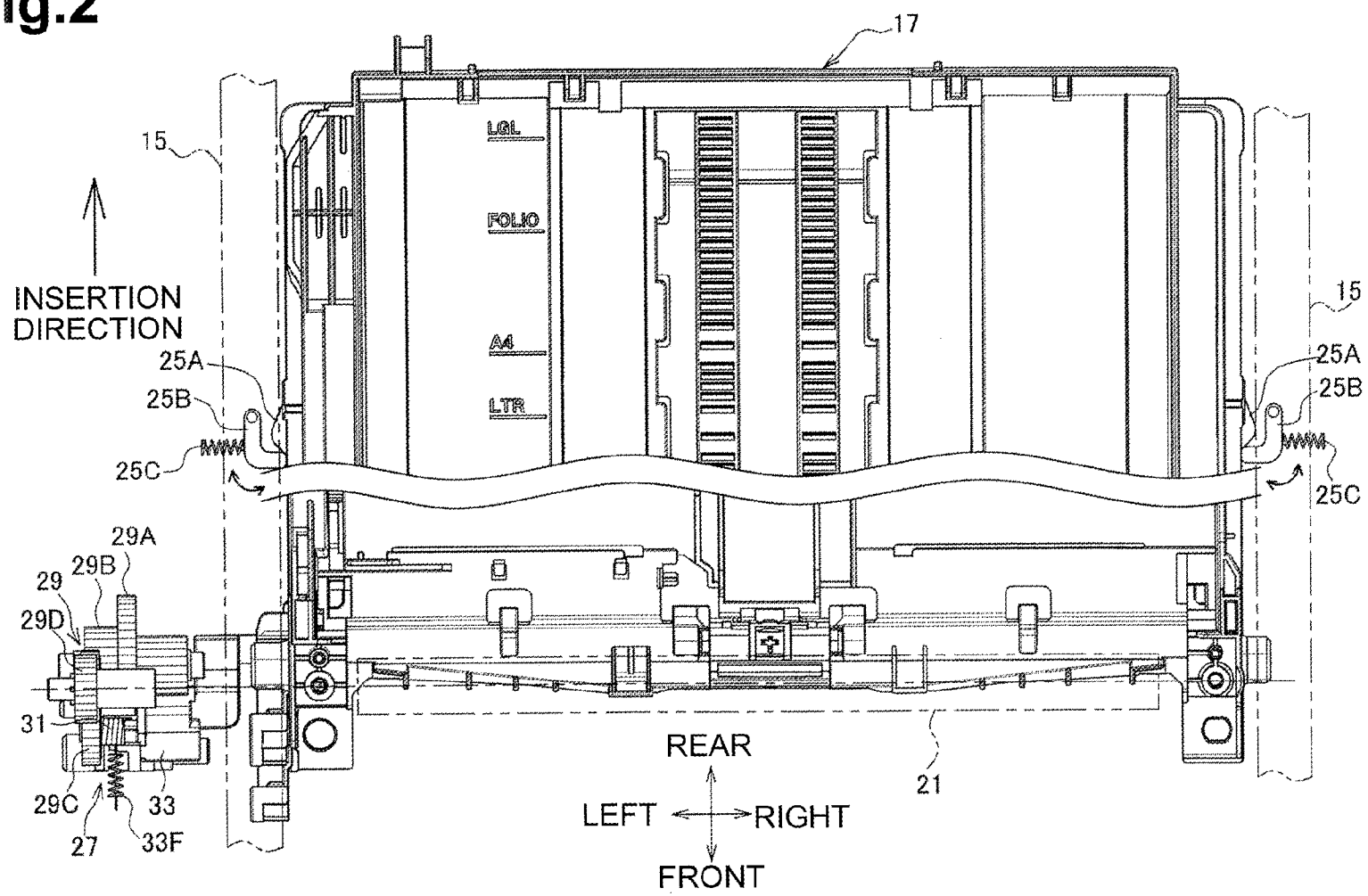
FIG. 2 is a top view of a sheet supply tray.
Figure 3:
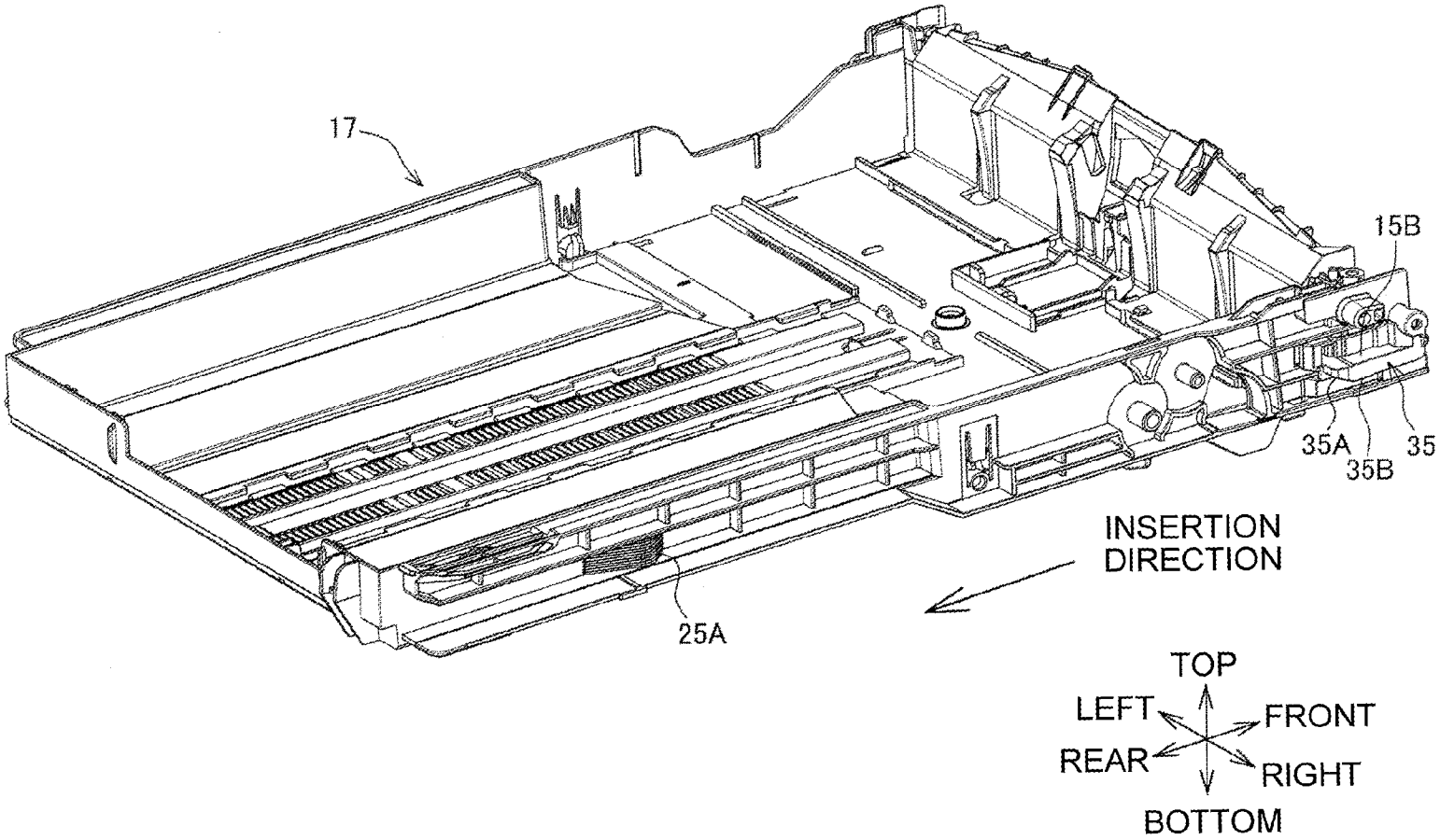
FIG. 3 is a perspective view of the sheet supply tray.

As illustrated in FIG. 2, the sheet supply tray 17 is disposed in the lower space of the apparatus between the two main frames 15. As illustrated in FIGS. 2 and 3, a locked portion 25A having a shape of a protrusion is formed on either side surface of the sheet supply tray 17 so as to protrude towards the corresponding main frame 15.

As illustrated in FIG. 2, each of the two main frames 15 has a locking arm 25B formed therein. The locking arm 25B locks the locked portion 25A. The locking arm 25B is assembled to the main frame 15 so as to be movable closer to and away from the locked portion 25A.

A spring 25C generates an elastic force in a direction in which the locking arm 25B is urged against the locked portion 25A. When the locking arm 25B is engaged with the locked portion 25A and, thus, enters in an engagement state, the locking arm 25B applies a pressing force to the locked portion 25A in a direction in which the sheet supply tray 17 is urged toward a leading end side in an insertion direction of the sheet supply tray 17. Accordingly, the locking arm 25B functions as a retaining mechanism that retains the position of the sheet supply tray 17 mounted in the chassis 3.

As used herein, the term "insertion direction" refers to a direction to insert the sheet supply tray 17 into the main body. According to the present illustrative embodiment, the insertion direction is the horizontal direction that is the same as the front-rear direction of the image forming apparatus 1. The sheet supply tray 17 is inserted toward the rear side of the image forming apparatus 1 through the opening 3C formed in the front surface of the image forming apparatus 1. Thus, according to the present illustrative embodiment, the leading end side in the insertion direction is the same as the rear side of the image forming apparatus 1.

As illustrated in FIG. 1, a feed roller 21 is disposed downstream of the feeder mechanism 19 in the sheet feeding direction. The feed roller 21 feeds a sheet supplied from the feeder mechanism 19 toward the image forming unit 5. The feed roller 21 is disposed on the main body. The feed roller 21 is in contact with the sheet and provides the sheet with a feeding force. The sheet supply tray 17 includes a pinch roller 21A, which urges a sheet against the feed roller 21.

The feed roller 21 receives a driving force from an electric motor (not illustrated). A driving force transmission path from the electric motor to the feed roller 21 includes a clutch mechanism 27 (described in detail below). The clutch mechanism 27 connects or disconnects the transmission path in accordance with the position of the sheet supply tray 17 relative to the main body.

A pair of registration rollers 23 is disposed downstream of the feed roller 21 in the sheet feeding direction. The pair of registration rollers 23 corrects skew of the sheet fed from the feed roller 21 and, thereafter, allows the sheet to enter the image forming unit 5 at a predetermined point in time.

The clutch mechanism 27 is configured to cut off transmission of a driving force to the feed roller 21 when the sheet supply tray 17 is removed from the main body. In addition, the clutch mechanism 27 allows for the transmission of a drive force when the sheet supply tray 17 is mounted in the main body.

Figure 4:
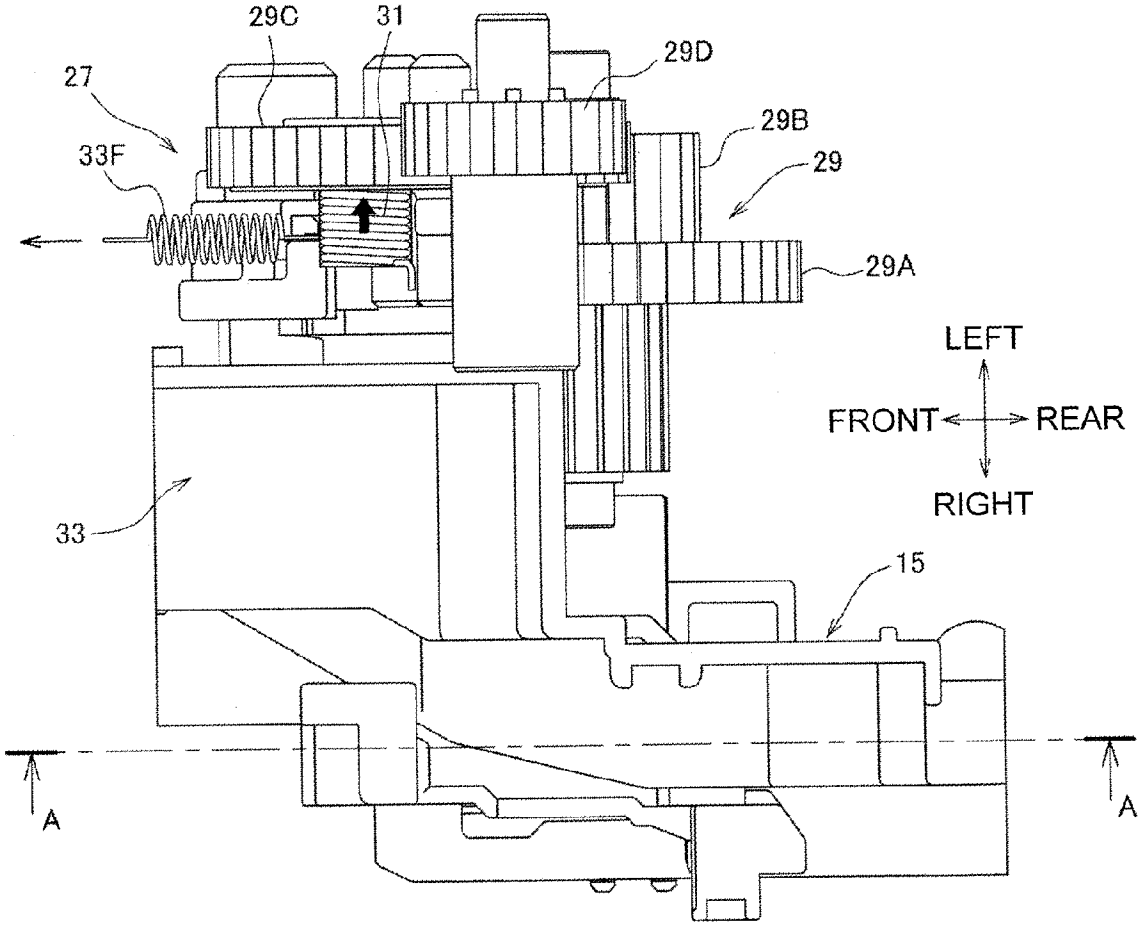
FIG. 4 is a top view of a clutch mechanism.

As illustrated in FIG. 4, a transmission path 29 from the electric motor to the feed roller 21 is formed from a plurality of gears 29A to 29D. The input gear 29A is configured to receive the driving force from the electric motor. The sun gear 29B is configured to rotate in unison with the input gear 29A, and engage a planetary gear 29C to transmit the driving force to the planetary gear 29C.

The position of the rotation center shaft (not illustrated) of the input gear 29A and the sun gear 29B is fixed relative to the main frame 15. That is, the input gear 29A and the sun gear 29B are configured to rotate at the original positions without being moved relative to the main frame 15.

The rotation center shaft of the input gear 29A and the sun gear 29B is rotatably supported by a pair of sub-frames (not illustrated) fixed to one of the main frames 15 (e.g. the left main frame 15). The sub-frames are plate-like members and are disposed on respective sides of the set of the gears 29A to 29D in the axis direction.

The planetary gear 29C is configured to rotate in continuous engagement with the sun gear 29B. The planetary gear 29C is movable between a position at which the planetary gear 29C engages the gear 29D (refer to FIG. 5A) and a position at which the planetary gear 29C is separated from the gear 29D (refer to FIG. 6A).

Figure 5A:
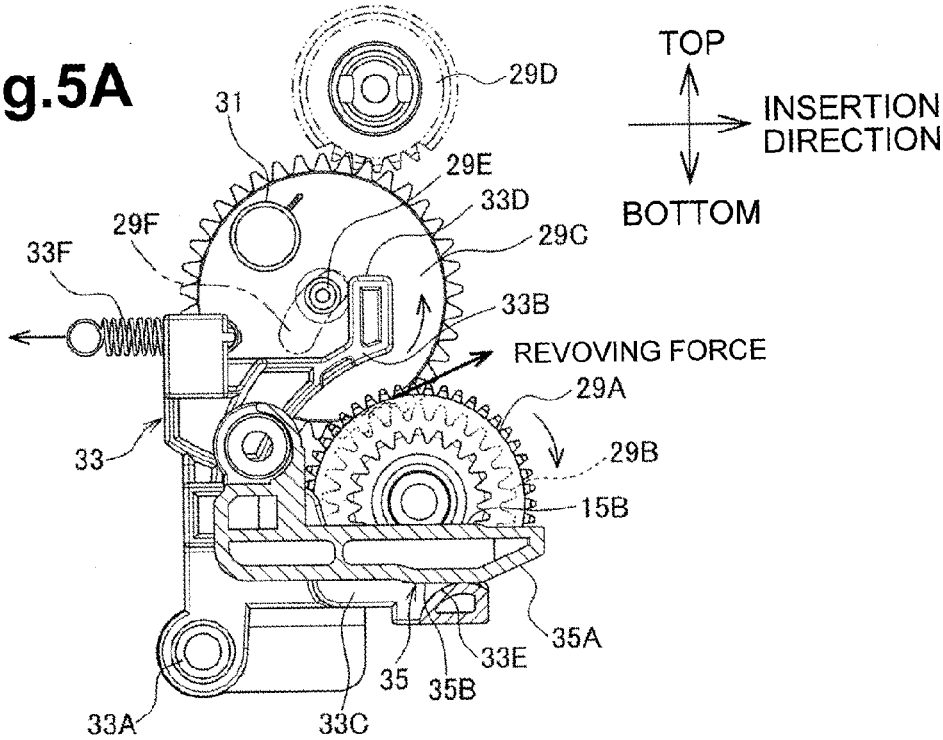
FIGS. 5A and 5B are cross-sectional views taken along a line A-A of FIG. 4 and illustrate the clutch mechanism by which a driving force is transmittable.

That is, as illustrated in FIG. 5A, each of the sub-frames includes a bearing portion 29F that rotatably supports a rotation center shaft 29E on which the planetary gear 29C rotates. The bearing portion 29F has a slot shape. The bearing portion 29F is a slide bearing that allows the rotation center shaft 29E to be in slide contact with the inner peripheral surface thereof. The shape of the slot in the major axis direction is a circular arc having a center of curvature that is coincident with the rotation center of the sun gear 29B.

A portion of a side surface of the planetary gear 29C located opposite to the sun gear 29B relative to the rotation center shaft 29E is subjected to a drag force from a resistance member 31. The resistance member 31 exerts, on the planetary gear 29C, a drag force that prevents the rotation center shaft 29E of the planetary gear 29C rotating thereon from remaining at a fixed position. As illustrated in FIG. 4, the resistance member 31 is made from a resilient member, such as a coil spring.

The output gear 29D is configured to receive the driving force from the planetary gear 29C. The driving force received by the output gear 29D is transmitted to the feed roller 21. That is, when the planetary gear 29C is in engagement with the output gear 29D, it becomes possible to transmit the driving force to the feed roller 21. In contrast, when the planetary gear 29C is disengaged from the output gear 29D, the transmission of the driving force to the feed roller 21 is cut off.

Figure 6A:
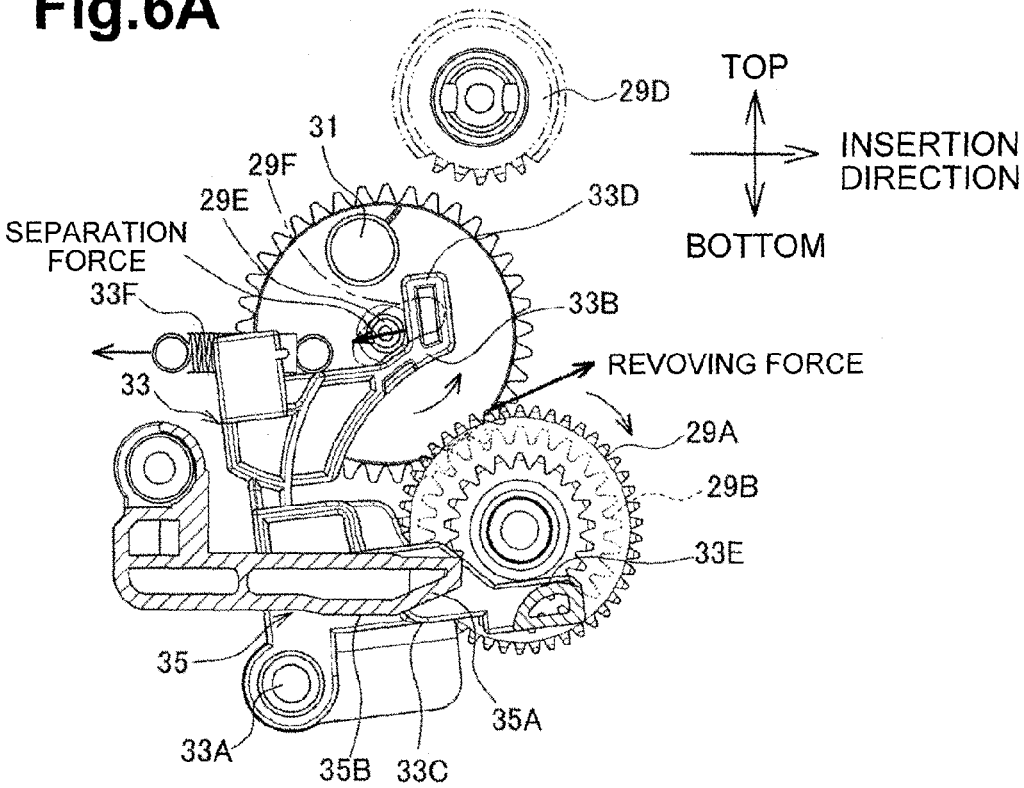
FIGS. 6A and 6B are cross-sectional views taken along a line A-A of FIG. 4 and illustrate the clutch mechanism by which transmission of the driving force is cut off.

A clutch lever 33 is a pivotable member that exerts a force to move the rotation center shaft 29E (hereinafter referred to as a "separation force") on the rotation center shaft 29E. As illustrated in FIG. 6A, the direction of the separation force is a direction in which the planetary gear 29C is separated from the output gear 29D.

The clutch lever 33 is movably attached to the main body (the main frame 15 or the sub-frames in the present illustrative embodiment). Specifically, the clutch lever 33 includes a shaft portion 33A. The shaft portion 33A is rotatably attached to the main body. Accordingly, the clutch lever 33 is pivotable about the shaft portion 33A.

Figure 7:
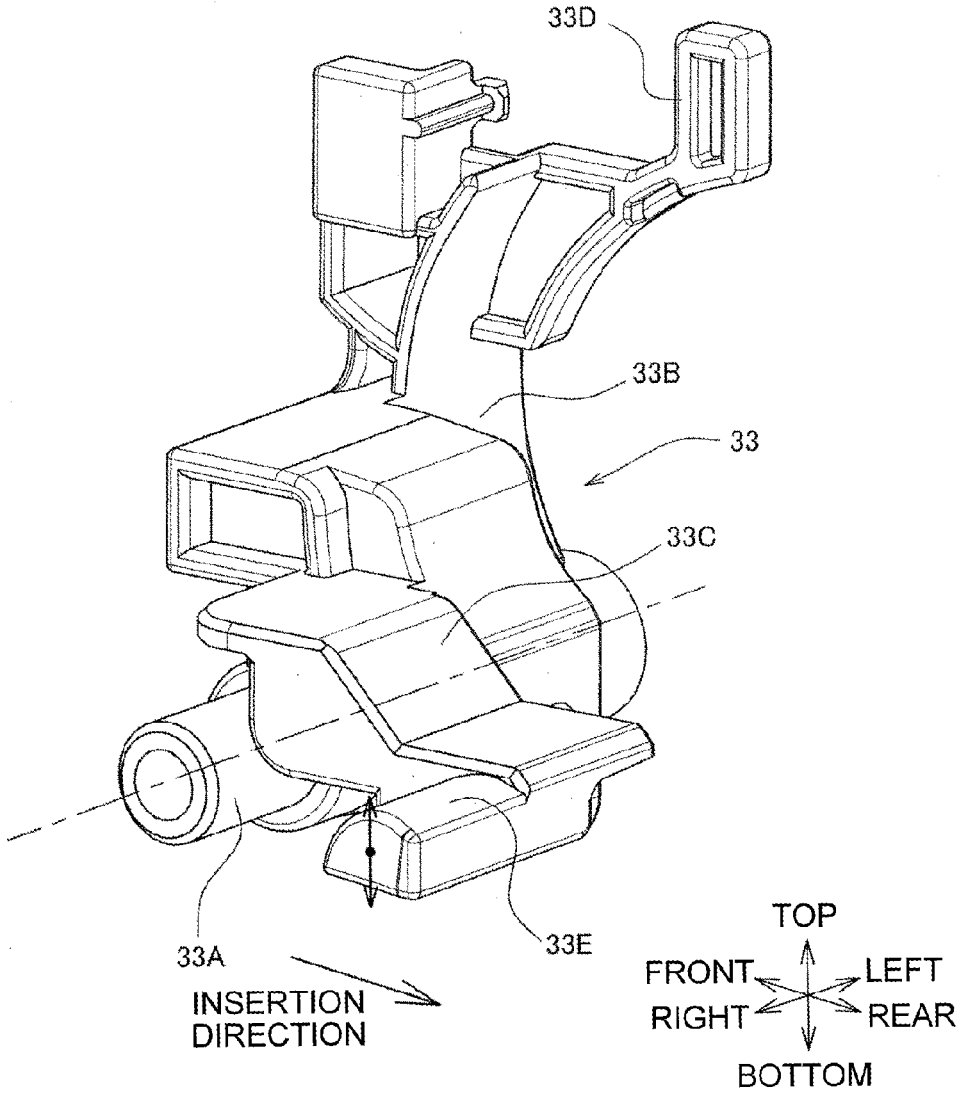
FIG. 7 is a perspective view of a clutch lever.

The clutch lever 33 further includes a first arm portion 33B and a second arm portion 33C. As illustrated in FIGS. 6A and 7, the first arm portion 33B extends from near the shaft portion 33A toward the rotation center shaft 29E. The first arm portion 33B has a hook portion 33D at an end adjacent to the rotation center shaft 29E. The hook portion 33D is in contact with the rotation center shaft 29E and exerts the separation force on the rotation center shaft 29E.

The second arm portion 33C extends from near the shaft portion 33A in the insertion direction of the sheet supply tray 17. The second arm portion 33C has a contact portion 33E at an end remote from the shaft portion 33A. As illustrated in FIG. 5A, the contact portion 33E is in contact with a contact portion 35 provided in the sheet supply tray 17.

As illustrated in FIG. 3, the contact portion 35 is disposed in a rear end portion (the front end portion in the present illustrative embodiment) of the side surface of the sheet supply tray 17 in the insertion direction. As illustrated in FIG. 5A, when the sheet supply tray 17 is mounted in the main body, an upper surface of the contact portion 33E is in contact with a lower surface of the contact portion 35.

A spring 33F generates the above-described separation force. That is, the elastic force exerted on the clutch lever 33 by the spring 33F causes the hook portion 33D to move in the direction of the separation force. At that time, since the clutch lever 33 is pivotable about the shaft portion 33A, the spring 33F also exerts, on the clutch lever 33, a force to move the contact portion 33E upward.

Accordingly, as illustrated in FIG. 6A, when the sheet supply tray 17 is removed from the main body, the contact portion 35 is separated from the contact portion 33E. In addition, the contact portion 33E moves from the position illustrated in FIG. 5A upward. That is, the contact portion 33E is movable in the vertical direction. A force exerted on the contact portion 35 by the contact portion 33E (hereinafter referred to as a "contact force") is directed upward.

At least part of the contact portion 33E that contacts the contact portion 35 is formed as a curved surface that is inclined with respect to the insertion direction. The curved surface is a cylindrical surface that is convex toward the contact portion 35 (upward). The axial direction of the cylindrical surface is parallel to the axial direction of the shaft portion 33A.

The contact portion 35 includes an introduction surface 35A located in a leading end portion thereof in the insertion direction and a contacted surface 35B that continuously extends from the introduction surface 35A toward a trailing end portion thereof in the insertion direction. The introduction surface 35A is inclined with respect to the insertion direction so as to be closer to the contact portion 33E toward the trailing end portion of the contact portion 35 in the insertion direction.

Figure 5B:
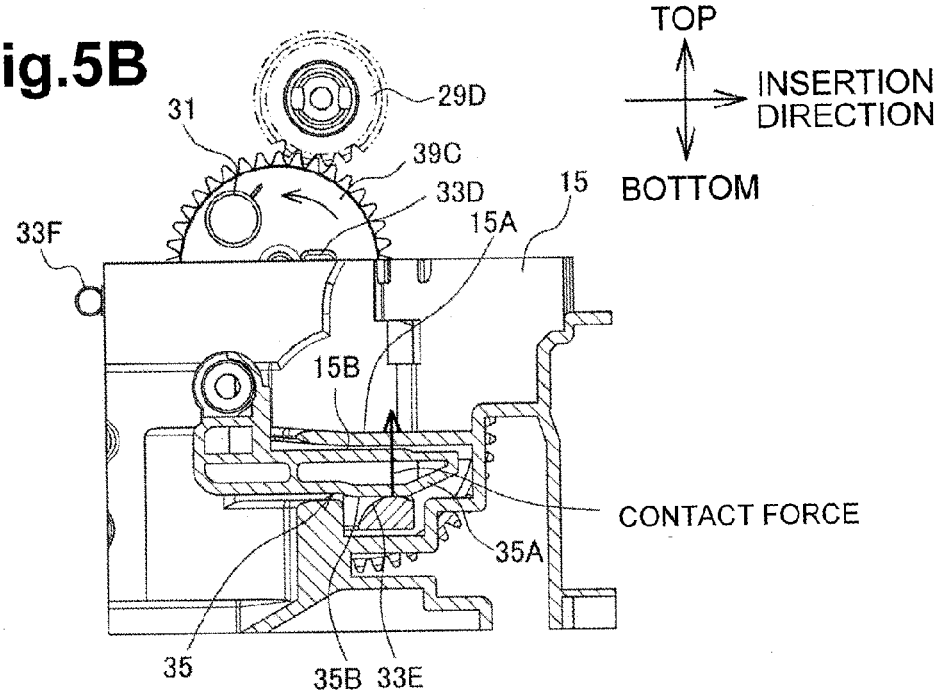

As illustrated in FIG. 5B, the main body (the main frame 15 in the present illustrative embodiment) includes a regulating portion 15A that regulates movement of the sheet supply tray 17 caused by the contact force. When the sheet supply tray 17 is mounted in the main body, the sheet supply tray 17 tends to be moved in the direction of the contact force (upward in the present illustrative embodiment) as a result of receiving the contact force. When the sheet supply tray 17 is moved by a predetermined dimension or greater in the direction of the contact force, the regulating portion 15A contacts the sheet supply tray 17 and regulates the movement.

According to the present illustrative embodiment, the regulating portion 15A is disposed on a line of action of the contact force. That is, a portion of the sheet supply tray 17 that is in contact with the regulating portion 15A (hereinafter referred to as a "regulated portion 15B") is not shifted in the horizontal direction from the line of action of the contact force. Thus, the regulated portion 15B and the contact portion 33E are disposed on the line of action of the contact force.

In the present illustrative embodiment, as illustrated in FIG. 3, the contact portion 35 is a protrusion that protrudes from the side surface of the sheet supply tray 17 in the horizontal direction. In addition, the contacted surface 35B is provided on the lower side of the protrusion that serves as the contact portion 35. Furthermore, the regulated portion 15B is disposed in the upper side of the protrusion that serves as the contact portion 35.

As illustrated in FIGS. 5A and 5B, when the sheet supply tray 17 is inserted into the main body and is mounted in the main body and, thus, the contact portion 33E is in contact with the contact portion 35, the planetary gear 29C engages the output gear 29D. As a result, the clutch mechanism 27 can transmit the driving force.

Figure 6B:
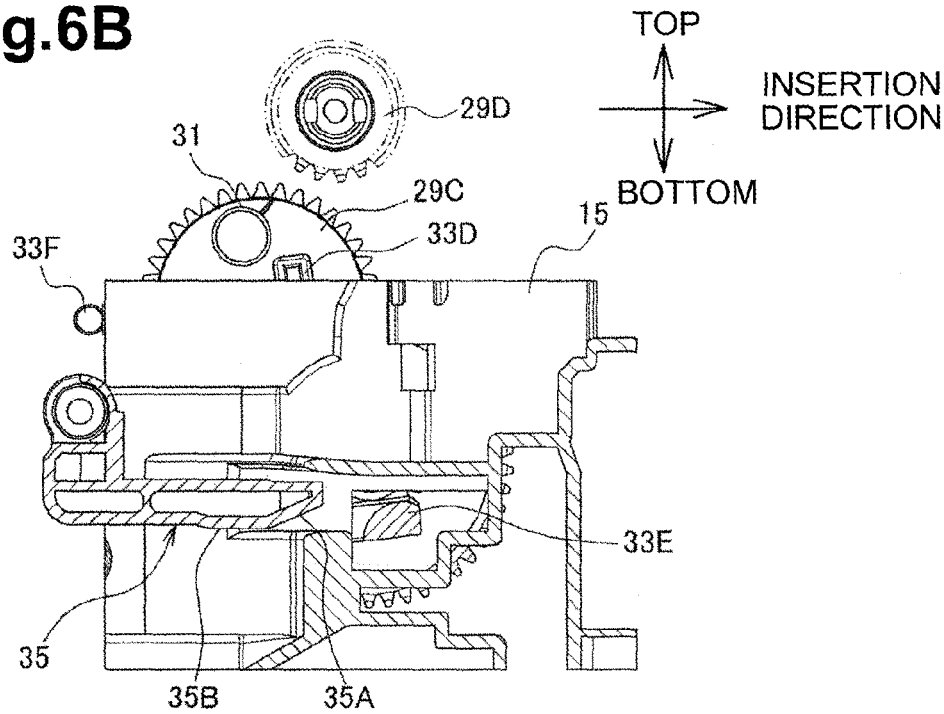

As illustrated in FIGS. 6A and 6B, when the sheet supply tray 17 is pulled out and, thus, the contact portion 33E is separated from the contact portion 35, the planetary gear 29C is disengaged from the output gear 29D in the clutch mechanism 27. Thus, transmission of the driving force is cut off.

That is, as illustrated in FIG. 5A, when the contact portion 33E is in contact with the contact portion 35, the contact portion 33E is urged downward by the contact portion 35. Thus, the hook portion 33D is separated from the rotation center shaft 29E.

In addition, when the contact portion 33E is in contact with the contact portion 35, the rotation center shaft 29E is allowed to move in the bearing portion 29F. When the sun gear 29B rotates, a force that allows the rotation center shaft 29E to move in the direction of the engagement pressure (that is, a force that allows the planetary gear 29C to revolve about the sun gear 29B while rotating on the rotation center shaft 29E, hereinafter also referred to as a revolving force) is exerted on the planetary gear 29C.

The term "engagement pressure" refers to a force generated by an engagement portion between the planetary gear 29C and the sun gear 29B, that is, a force exerted on the planetary gear 29C by the sun gear 29B. The term "direction of the engagement pressure" refers to a direction that is the same as the direction of a pressure angle formed at the engagement portion by the planetary gear 29C and the sun gear 29B. The engagement pressure has a component of a direction from the rotation center shaft 29E toward the output gear 29D.

Accordingly, when the sun gear 29B rotates, the planetary gear 29C receives, from the resistance member 31, a force that prevents the rotation center shaft 29E of planetary gear 29C from remaining in the fixed position. In other words, the planetary gear 29C receives the revolving force and revolves around the sun gear 29B while rotating on the rotation center shaft 29E until the planetary gear 29C comes into contact with the output gear 29D. When the planetary gear 29C comes into contact with the output gear 29D, the planetary gear 29C and the output gear 29D engage each other. At that time, the movement of the rotation center shaft 29E of the planetary gear 29C in the bearing portion 29F is regulated by the output gear 29D. Accordingly, since the planetary gear 29C engages with the output gear 29D and rotates on the rotation center shaft 29E in the fixed position, the driving force is transmitted to the output gear 29D.

In addition, the spring 33F continuously exerts the separation force on the clutch lever 33. Accordingly, when the sheet supply tray 17 is pulled out and, thus, the contact portion 33E is separated from the contact portion 35, the hook portion 33D is in contact with the rotation center shaft 29E and, thus, the separation force of the spring 33F is exerted on the rotation center shaft 29E, as illustrated in FIG. 6A. In this manner, since the planetary gear 29C is disengaged from the output gear 29D, transmission of the driving force exerted on the output gear 29D is cut off.

According to the present illustrative embodiment, when the sheet supply tray 17 is mounted or dismounted, the sheet supply tray 17 is moved in the horizontal direction. In addition, when the sheet supply tray 17 is mounted in the main body and, thus, the driving force is transmittable, the contact force is exerted on the sheet supply tray 17 in the vertical direction.

That is, according to the present illustrative embodiment, when the sheet supply tray 17 is mounted in the main body and, thus, the driving force is transmittable, the clutch lever 33 prevents a force having a direction in which the sheet supply tray 17 is removed from the main body from acting on the sheet supply tray 17.

Accordingly, the need to increase the retaining force of the locking arm 25B that constitutes the retaining mechanism can be reduced. Thus, the force required for installation and removal of the sheet supply tray 17 can be reduced. Consequently, degradation of an installation and removal operation of the sheet supply tray 17 can be prevented.

When a user moves the sheet supply tray 17 relative to the main body, the sheet supply tray 17 slides on the main body. Accordingly, the sheet supply tray 17 is subjected to a frictional force having a direction in which the sheet supply tray 17 is prevented from moving. The frictional force is generated by regarding mainly the force of gravity that acts on the sheet supply tray 17 as a normal force.

Let the direction of the contact force be a downward direction. Then, the direction of the contact force is the same as the direction of the force of gravity that acts on the sheet supply tray 17. Accordingly, the normal force that generates the frictional force has a magnitude obtained by adding the contact force to the force of gravity.

In contrast, let the direction of the contact force be an upward direction. Then, the direction of the contact force is opposite to the direction of the force of gravity that acts on the sheet supply tray 17. Accordingly, the normal force that generates the frictional force has a magnitude obtained by subtracting the contact force from the force of gravity. Accordingly, when the direction of the contact force is an upward direction, the force required for installation and removal of the sheet supply tray 17 can be reduced compared with a case in which the direction of the contact force is a downward direction.

The present illustrative embodiment is characterized in that the contact portion 33E is formed as a curved surface inclined with respect to the insertion direction of the sheet supply tray 17. In this manner, even when the contact angle varies when the contact portion 33E contacts (or chits) the contact portion 35, large deviation of the direction of the contact force from the vertical direction can be prevented.

In addition, the contact portion 33E is formed as a curved surface. This prevents a large resistance force from being generated at a contact portion where the contact portion 33E contacts the contact portion 35 when the sheet supply tray 17 is mounted or removed.

While the above illustrative embodiment has been described with reference to an upward contact force, that is, an upward force exerted on the sheet supply tray 17 by the contact portion 33E, the direction of the contact force is not limited thereto. For example, the direction of the contact force may be a downward direction.

While the above illustrative embodiment has been described with reference to the contact portion 33E formed as a curved surface, the shape of the contact portion 33E is not limited thereto. For example, the contact portion 33E is formed as a flat slope surface. In addition, while the above illustrative embodiment has been described with reference to the introduction surface 35A disposed in a leading end portion of the contact portion 35 in the insertion direction, the disclosure is not limited thereto. For example, the need for the introduction surface 35A may be eliminated.

While the above illustrative embodiment has been described with reference to the regulating portion 15A, the disclosure is not limited thereto. For example, the need for the regulating portion 15A may be eliminated. In addition, while the above illustrative embodiment has been described with reference to the regulating portion 15A located on the line of action of the contact force, the location of the regulating portion 15A is not limited thereto. For example, the regulating portion 15A may be shifted in the horizontal direction from the line of action of the contact force.

While the above illustrative embodiment has been described with reference to the clutch mechanism 27 that transmits or cuts off the driving force using the revolving movement of the planetary gear 29C, the disclosure is not limited thereto. For example, the clutch mechanism 27 may be formed from, for example, an electromagnetic clutch.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

an image forming unit configured to form an image on a sheet;

a main body including the image forming unit and having an opening open in a horizontal direction;

a sheet supply tray detachably attached to the main body through the opening and configured to receive a stack of sheets to be supplied to the image forming unit, the sheet supply tray including a contact portion;

a feed roller disposed at the main body and configured to feed a sheet received at the sheet supply tray toward the image forming unit;

a retaining mechanism disposed at the main body and downstream of the feed roller in a direction in which the sheet supply tray is attached to the main body, the retaining mechanism being configured to retain the sheet supply tray attached to the main body;

a pivotable member disposed at the main body and including a contact portion, the pivotable member being configured to, when the sheet supply tray is attached to the main body, pivot from a first position to a second position different from the first position in a vertical direction by the contact portion of the pivotable member receiving a force having the vertical direction from the contact portion of the sheet supply tray; and a clutch mechanism configured to, when the contact portion of the pivotable member is in contact with the contact portion of the sheet supply tray, transmit a driving force to the feed roller, the clutch mechanism being configured to, when the contact portion of the pivotable member is separated from the contacted portion of the sheet supply tray, cut off transmission of the driving force to the feed roller, wherein the contact portion of the pivotable member is formed as a curved surface inclined with respect to an insertion direction in which the sheet supply tray is inserted into the main body.

2. The image forming apparatus according to claim 1, wherein an upper surface of the contact portion of the pivotable member contacts a lower surface of the contact portion of the sheet supply tray when the sheet supply tray is attached to the main body.

3. The image forming apparatus according to claim 1, further comprising a spring configured to exert a force on the pivotable member to move the contact portion of the pivotable member upward.

4. The image forming apparatus according to claim 1, wherein the contact portion of the sheet supply tray has an introduction surface disposed in a leading end portion of the contact portion in the insertion direction, and the introduction surface is inclined with respect to the insertion direction.

5. The image forming apparatus according to claim 1, wherein the main body further includes a regulating portion configured to regulate the sheet supply tray from moving in a direction of a force which the contact portion of the pivotable member applies to the contact portion of the sheet supply tray.

6. The image forming apparatus according to claim 5, wherein the regulating portion is disposed on a line of action of the force which the contact portion of the pivotable member applies to the contact portion of the sheet supply tray.

7. The image forming apparatus according to claim 1, wherein the retaining mechanism includes an arm configured to engage a portion of the sheet supply tray attached to the main body.

8. The image forming apparatus according to claim 1, wherein the retaining mechanism and the pivotable member are disposed on a same sidewall of the main body.

9. The image forming apparatus according to claim 1, wherein the pivotable member is disposed upstream of the retaining mechanism in the direction in which the sheet supply tray is attached to the main body.

10. The image forming apparatus according to claim 1, wherein, when the sheet supply tray is attached to the main body, the contact portion of the pivotable member receives a force having an upward direction from the contact portion of the sheet supply tray.

* * * * *